US010456611B2

(12) United States Patent
Wagner

(10) Patent No.: US 10,456,611 B2
(45) Date of Patent: Oct. 29, 2019

(54) OXYGEN REDUCTION SYSTEM AND METHOD FOR CONFIGURING AN OXYGEN REDUCTION SYSTEM

(71) Applicant: AMRONA AG, Zug (CH)

(72) Inventor: Ernst-Werner Wagner, Winsen/Aller (DE)

(73) Assignee: AMRONA AG, Zug (CH)

( * ) Notice: Subject to any disclaimer, the term of this patent is extended or adjusted under 35 U.S.C. 154(b) by 138 days.

(21) Appl. No.: 15/738,621

(22) PCT Filed: Jun. 20, 2016

(86) PCT No.: PCT/EP2016/064148
§ 371 (c)(1),
(2) Date: Dec. 21, 2017

(87) PCT Pub. No.: WO2017/001222
PCT Pub. Date: Jan. 5, 2017

(65) Prior Publication Data

US 2018/0185684 A1 Jul. 5, 2018

(30) Foreign Application Priority Data

Jul. 2, 2015 (EP) ..... 15175014

(51) Int. Cl.
*A62C 99/00* (2010.01)
*A62C 3/00* (2006.01)
*A62C 3/16* (2006.01)

(52) U.S. Cl.
CPC ..... *A62C 99/0018* (2013.01); *A62C 3/002* (2013.01); *A62C 3/16* (2013.01)

(58) Field of Classification Search
CPC ..... B01D 53/047; B01D 53/04; A62C 3/002; A62C 3/16; A62C 99/0018
(Continued)

(56) References Cited

U.S. PATENT DOCUMENTS 4,378,920 A 4/1983 Runnels et al.
2008/0135265 A1* 6/2008 Wagner ..... A62C 99/0018 169/45
(Continued)

FOREIGN PATENT DOCUMENTS

EP 1550481 A1 7/2005
EP 2724754 A1 4/2014

*Primary Examiner* — Frank M Lawrence, Jr.
(74) *Attorney, Agent, or Firm* — Shumaker, Loop & Kendrick, LLP; James D. Miller

(57) ABSTRACT

A system for reducing the oxygen content in the spatial atmosphere of an enclosed area and/or for maintaining a reduced oxygen content in the spatial atmosphere of an enclosed area below a predefined and reduced operating concentration in comparison to the oxygen concentration of the normal ambient air. The system includes a gas separation system to that end, the outlet of which is fluidly connected to the enclosed area in order to continuously supply an oxygen-reduced gas mixture or oxygen-displacing gas. The gas separation system is configured such that the oxygen concentration in the spatial atmosphere of the enclosed area always remains in a range between the predefined operating concentration and a predefined or definable lower limit concentration during a continuous operation of the gas separation system.

15 Claims, 3 Drawing Sheets

(58) Field of Classification Search
USPC ..... 96/108, 115, 116; 95/96, 130
See application file for complete search history.

(56) References Cited

U.S. PATENT DOCUMENTS

| | | | | |
|---|---|---|---|---|
| 2010/0077921 | A1* | 4/2010 | Haggerty | B01D 53/047 95/101 |
| 2014/0326021 | A1* | 11/2014 | Wagner | A62C 99/0018 62/617 |
| 2015/0184877 | A1* | 7/2015 | Anselm | A62C 99/0018 96/113 |
| 2015/0323411 | A1* | 11/2015 | Eberlein | G01M 3/3263 73/40 |

* cited by examiner

OXYGEN REDUCTION SYSTEM AND METHOD FOR CONFIGURING AN OXYGEN REDUCTION SYSTEM

CROSS-REFERENCE TO RELATED PATENT APPLICATIONS

This patent application is a United States national phase patent application based on PCT/EP2016/064148 filed Jun. 20, 2016, which claims the benefit of European Patent Application No. EP 15175014.8 filed Jul. 2, 2015, the entire disclosures of which are hereby incorporated herein by reference.

FIELD

The present invention relates to a system for reducing the oxygen content in the spatial atmosphere of an enclosed area or respectively maintaining a reduced oxygen content in the spatial atmosphere of an enclosed area below a predefined and reduced concentration (operating concentration) in comparison to the oxygen concentration of the normal ambient air.

The system according to the invention is in particular configured to prevent the development or spread of fire by introducing an oxygen-reduced gas mixture or an oxygen-displacing gas into the spatial atmosphere of an enclosed area. The system according to the invention is in principle moreover also suited to extinguishing fires in the enclosed area.

Hence, the inventive system serves for example in minimizing risk and in extinguishing fires in an area subject to monitoring, whereby the enclosed area is also or can be continuously rendered inert to different drawdown levels for the purpose of preventing or controlling fire.

BACKGROUND

The basic principle behind inerting technology to prevent fires is based on the knowledge that when the equipment within enclosed areas reacts sensitively to the effects of water, the risk of fire can be countered by reducing the oxygen concentration in the relevant area to a value of for example 15% by volume. Most combustible materials can no longer ignite at such a (reduced) oxygen concentration. Accordingly, the main areas of application for this inerting technology in preventing fires also include IT areas, electrical switching and distribution rooms, enclosed facilities as well as storage areas containing high-value commercial goods.

The fire prevention effect resulting from this inerting technology is based on the principle of oxygen displacement. As is known, normal ambient air consists of 21% oxygen by volume, 78% nitrogen by volume and 1% by volume of other gases. For fire prevention purposes, the oxygen content of the spatial atmosphere within the enclosed area is reduced by introducing an oxygen-reduced gas mixture or an oxygen-displacing gas such as for example nitrogen.

Another example of application of the inventive system is in the storing of items, particularly food, preferentially pomaceous fruit, in a controlled atmosphere (CA) in which, among other things, the proportional percentage of atmospheric oxygen is regulated in order to slow the aging process acting on the perishable goods.

Oxygen reduction systems, in particular those used as fire prevention systems, fire extinguishing systems, explosion suppression systems or explosion prevention systems, which create an atmosphere of permanently lower oxygen concentration than the surrounding conditions within an enclosed area, in particular have the advantage—compared to water extinguishing systems such as e.g. sprinkler systems or spray mist systems—of being suited to the extinguishing of the volume. To that end, however, it is necessary to let a precalculated (minimum) volume of oxygen-reduced gas mixture/oxygen-displacing gas into the enclosed area in order to fulfill the intended purpose of the oxygen reduction system of for instance fire prevention, explosion suppression, explosion control or fire extinguishing. Said (minimum) volume of oxygen-reduced gas mixture/oxygen-displacing gas to be let into the area is calculated according to the effective volume and the airtightness of the enclosed area's spatial shell.

The airtightness of the spatial shell of an enclosed area such as, for example, a building envelope, is usually determined by a pressure differential test (blower door test). A fan brought into a spatial shell thereby generates and maintains a constant overpressure and negative pressure of (for example) 50 Pa within the enclosed area. The volume of air escaping through leakages in the spatial shell of the enclosed area is to be forced into the enclosed area by the fan and measured. The so-called n50 value (unit: l/h) indicates how often the interior volume is replaced per hour.

The airtightness determined by a pressure differential test thus corresponds to an air exchange rate contingent on the leakages in a spatial shell of the enclosed area which will also be referred herein to as "feed-independent air exchange rate." In particular, however, the airtightness determined by a pressure differential test does not factor in an exchange of air involving openings such as doors, gates or windows which can be formed in the spatial shell as needed for the purpose of infeed and/or accessing the enclosed area. This air exchange rate will also be referred herein to as "feed-dependent air exchange rate."

In contrast to the feed-independent air exchange rate, the feed-dependent air exchange rate cannot normally be determined in advance metrologically since the feed-dependent air exchange rate varies over time and depends on when and how often the spatial shell of the enclosed area is opened for the purpose of infeed and/or accessing, how long the opening formed in the spatial shell of the enclosed area for the purpose of infeed and/or accessing remains, and ultimately how large the opening is.

These parameters determining the feed-dependent air exchange rate normally cannot be determined in advance such that peak values are always assumed with respect to the feed-dependent air exchange rate of the enclosed area when configuring an oxygen reduction system by assuming maximum infeed and/or accessing. Doing so thereby ensures that even in extreme cases, the oxygen reduction system can always provide a sufficient volume of oxygen-displacing gas per unit of time so as to be able to reliably maintain a reduced oxygen content in the spatial atmosphere of the enclosed area below the predefined operating concentration.

SUMMARY

One task of the invention is to be seen in specifying a method for configuring an oxygen reduction system by which the oxygen reduction system is configured as optimally as possible in terms of the actual circumstances.

In particular, the feed-dependent air exchange rate actually occurring/existing in practice is to be factored into the configuring of the oxygen reduction system in order to thereby avoid an oversizing of the oxygen reduction system. At the same time, it needs to be ensured that the oxygen reduction system can at all times maintain the oxygen content in the spatial atmosphere of the enclosed area below a predefined and reduced operating concentration compared to the oxygen concentration of the normal ambient air.

Moreover to be specified is a corresponding oxygen reduction system which is better adapted to the actual circumstances of the enclosed area compared to oxygen reduction systems designed and configured per previous approaches.

With respect to the oxygen reduction system, the task on which the invention is based is solved by the subject matter as shown and described herein.

With respect to the method for configuring an oxygen reduction system for an enclosed area, the task on which the invention is based is solved by the subject matter as shown and described herein.

Accordingly, the invention relates in particular to an oxygen reduction system which is configured to reduce the oxygen content in the spatial atmosphere of an enclosed area to a concentration below a predefined and reduced operating concentration compared to the oxygen concentration of the normal ambient air. Alternatively or additionally thereto, the inventive oxygen reduction system is designed to maintain a reduced oxygen content in the spatial atmosphere of an enclosed area below a predefined and reduced operating concentration compared to the oxygen concentration of the normal ambient air.

To that end, the oxygen reduction system comprises a gas separation system, the outlet of which is fluidly connected to the enclosed area in order to continuously feed an oxygen-reduced gas mixture or an oxygen-displacing gas to the spatial atmosphere of the enclosed area. In other words, the invention provides for the gas separation system to be in continuous operation such that an oxygen-reduced gas mixture or an oxygen-displacing gas is fed to the spatial atmosphere of the enclosed area continuously; i.e. with no interruption over time.

The gas separation system is configured such that the oxygen concentration in the spatial atmosphere of the enclosed area always remains in a range between the predefined operating concentration and a predefined or definable lower limit concentration during a continuous operation of the gas separation system in a first operating mode. A volume of an oxygen-reduced gas mixture within a predefined or definable range is thereby continuously provided at the outlet of the gas separation system per unit of time in the first operating mode of the gas separation system.

The advantages able to be achieved with the inventive solution are obvious:

By providing for the gas separation system to be operated continuously, the oxygen-reduced gas mixture can be provided at the outlet of the gas separation system at a volume which corresponds over time to the average volume reflecting a larger dimensioned gas separation system operated intermittently. Therefore, the gas separation system or oxygen reduction system respectively can be of overall smaller dimensions compared to known prior art approaches, thereby reducing the initial installation costs of the oxygen reduction system.

The continuous operation of the gas separation system is moreover additionally associated with the further advantage of minimizing the wear inherent to the gas separation system being repeatedly switched on and off.

According to one aspect of the present invention, it is provided for the predefined and reduced operating concentration compared to the oxygen concentration of the normal ambient air to correspond to the design concentration of the enclosed area. According to VdS Guideline 3527 (version: date of filing), the design concentration thereby relates to the ignition threshold less a safety margin and thus depends on the materials stored within the enclosed area.

The present invention is not, however, limited to such embodiments in which the oxygen reduction system maintains a reduced oxygen content in the spatial atmosphere of an enclosed area below the design concentration of the area. The invention rather also encompasses embodiments in which a reduced oxygen content below a predefined and reduced operating concentration compared to the oxygen concentration of the normal ambient air is maintained in general in the spatial atmosphere of the enclosed area, whereby this predefined operating concentration can also be higher than the area's design concentration.

The inventive solution is in particular suitable for an oxygen reduction system configured in terms of an enclosed area, wherein the air exchange rate of the enclosed area varies cyclically over time. This is the case for example with rooms or warehouses in which the spatial shell is temporarily opened for access and/or infeed purposes, whereby the frequency of the access/infeed is subject to a certain cycle, e.g. a daily cycle or a weekly cycle, such that in overall terms, the air exchange rate of the enclosed area varies cyclically over time and each time cycle can be divided into a plurality of consecutive time periods. The average air exchange rate of the enclosed area thereby assumes a respective corresponding value for each time period.

It is thus for example conceivable for a warehouse in three-shift operation to be in use 6 days per week. In this example, it is thus provided for the total air exchange rate of the enclosed area (here: warehouse) to cyclically vary according to a weekly pattern, whereby the average total air exchange rate of the enclosed area (warehouse) during the six working days consists of a feed-dependent air exchange rate and a feed-independent air exchange rate. In contrast, the feed-dependent air exchange rate is negligible during the (sole) day off such that the average total air exchange rate essentially corresponds to the feed-independent air exchange rate of the enclosed area.

As already stated above, (unintended or unavoidable) leakages in the spatial shell of the enclosed area are factored into the feed-independent air exchange rate; i.e. those leakages which are unrelated to infeed and/or accessing the enclosed area. On the other hand, the feed-dependent air exchange rate factors in an exchange of air through openings in the spatial shell of the enclosed area which are (intentionally) formed as needed for the purpose of the infeed and/or accessing. Such openings refer in particular to doors, gates, air locks or windows.

In the application example in which the air exchange rate of the enclosed area cyclically varies over time, whereby each time cycle is divided into multiple consecutive time periods, one aspect of the present invention in particular provides for the gas separation system to be configured in consideration of the respective length of the time periods as well as in consideration of the respective average total air exchange rate for each time period such that with a continuous operation of the gas separation system in a first operating mode, the oxygen concentration in the spatial atmosphere of the enclosed area is always within a range between the predefined operating concentration (as for example the design concentration of the enclosed area) and the predefined or definable lower limit concentration.

One implementation of the inventive oxygen reduction system provides for the gas separation system to be operable in at least two and preferably three different operating modes. In these at least two operating modes, the gas separation system continuously provides an oxygen-reduced gas mixture at the outlet. In contrast to the first operating mode, however, the volume of oxygen-reduced gas mixture provided continuously at the outlet per unit of time is increased—relative to a reference value of a residual oxygen concentration—in the second operating mode of the gas separation system.

On the other hand, it is conceivable in this context for the gas separation system to be further operated in a third operating mode in which the volume of oxygen-reduced gas mixture continuously provided at the outlet per unit of time is reduced—relative to a reference value of a residual oxygen concentration—compared to the first operating mode.

The invention is not only limited to an oxygen reduction system of the above-described type but also relates to a method for configuring an oxygen reduction system for an enclosed area. The inventive method in particular comprises the following method steps thereto:

i) dividing a predefined time cycle into a plurality of consecutive time periods;

ii) establishing an average air exchange rate of the enclosed area for each time period;

iii) weighting the established average air exchange rate in terms of the respective durations of the corresponding time periods; and iv) adapting and/or selecting a gas separation system of the oxygen reduction system in consideration of the weighted average air exchange rates of the enclosed area such that the oxygen concentration in the spatial atmosphere of the enclosed area always remains within a range between a predefined operating concentration, such as for instance the design concentration of the enclosed area, and a predefinable lower limit concentration when the gas separation system is continuously operated in a first operating mode in which a volume of an oxygen-reduced gas mixture or oxygen-displacing gas within a predefined or definable range is continuously provided at the outlet of the gas separation system per unit of time.

BRIEF DESCRIPTION OF THE DRAWINGS

The following will make reference to the accompanying drawings in describing the invention in greater detail.

Shown are.

DETAILED DESCRIPTION OF THE EMBODIMENTS

Figure 1:
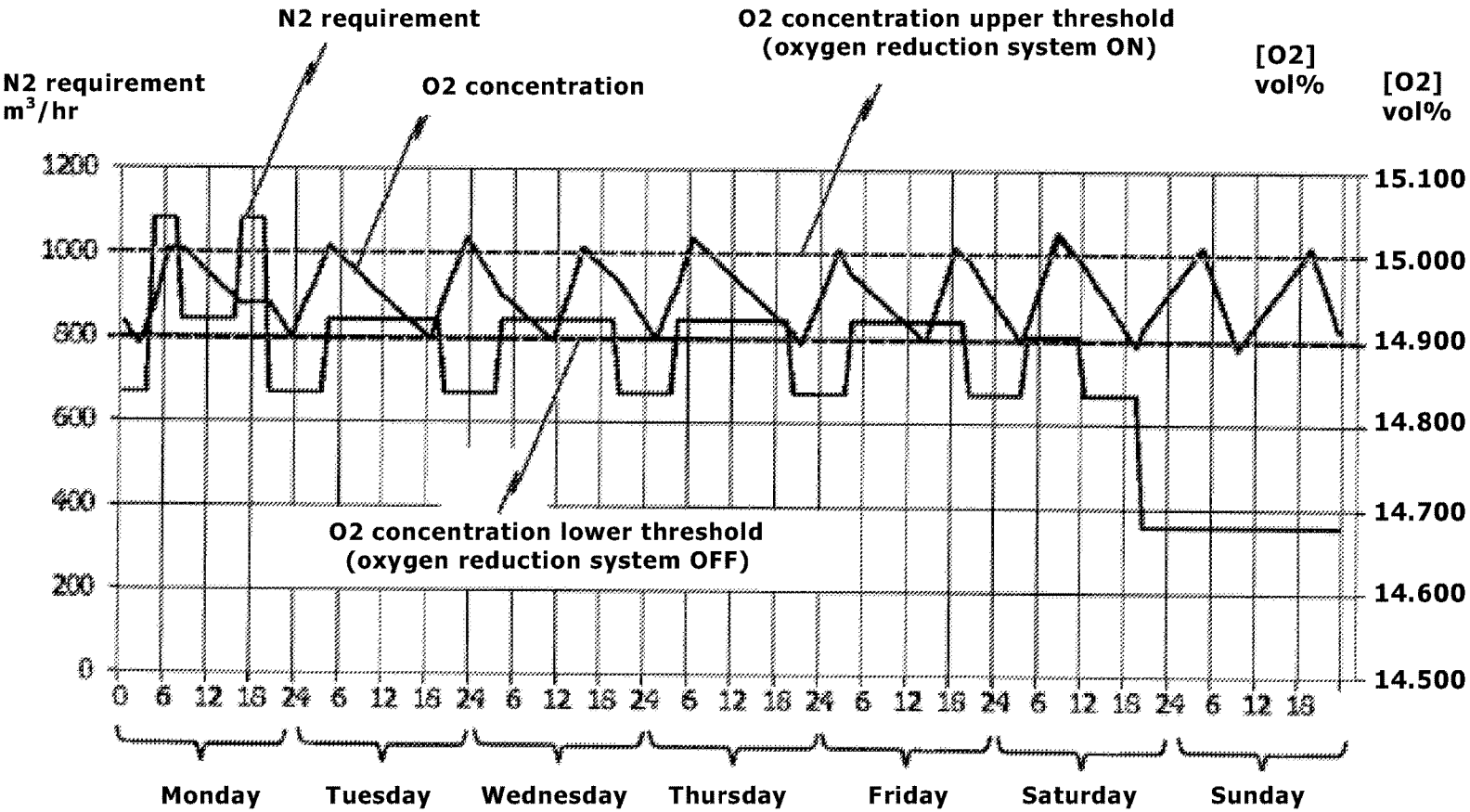
Fig. 1 (prior art)
FIG. 1 a basic time diagram illustrating the mode of operation of a conventional oxygen reduction system.

FIG. 1 shows a basic time diagram to illustrate the mode of operation of a conventional oxygen reduction system known from the prior art. This is an oxygen reduction system which is used to maintain the oxygen concentration in the spatial atmosphere of an enclosed area below a predefined and reduced concentration (=operating concentration) compared to the oxygen concentration of the normal ambient air. The relevant time period of the FIG. 1 time diagram amounts to a total of one week (7 days).

FIG. 1 in particular depicts the chronological development of the oxygen concentration in the spatial atmosphere of the enclosed area. It can be seen that the oxygen concentration is always within a range of between approximately 15.0% by volume and 14.9% by volume. This is a typical control range defined by an upper threshold and a lower threshold of the oxygen concentration in the spatial atmosphere of the enclosed area.

The upper threshold of the oxygen concentration in the spatial atmosphere of the enclosed area represents the switch-on threshold at which a gas separation system of the oxygen reduction system is switched on so as to provide an oxygen-reduced gas mixture at the outlet of the gas separation system. The oxygen-reduced gas mixture provided is then fed into the spatial atmosphere of the enclosed area so that the oxygen concentration in the spatial atmosphere subsequently decreases accordingly.

Upon reaching the lower threshold value, which defines the switch-off threshold of the gas separation system, the gas separation system ceases operation. The supply of the oxygen-reduced gas mixture into the spatial atmosphere of the enclosed area is thus halted, in consequence of which the oxygen concentration in the spatial atmosphere of the enclosed area correspondingly increases again.

This is due to the fact of the spatial shell of the enclosed area not being hermetically sealed but rather having (unintended or unavoidable) leakages in the spatial envelope which result in a certain (feed-independent) air exchange rate. This feed-independent air exchange rate can in particular be determined beforehand by means of a pressure differential test.

Additionally to this feed-independent air exchange rate, however, there is also a feed-dependent air exchange rate; i.e. an exchange of air through openings provided in the shell of the enclosed area which are opened for the purpose of infeed and/or accessing the enclosed area.

FIG. 1 depicts a situation in which the enclosed area is used 6 days out of the week (here: Monday to Saturday) in a three-shift operation. "Three-shift operational use" refers to semi-continuous full operation which only pauses in the example embodiment depicted in FIG. 1 on Sunday.

It can be seen from the chronological development of the oxygen concentration in the time diagram according to FIG. 1 that, as a whole, the spatial shell of the enclosed area is more airtight on Sunday than on the other days of the week. This can particularly be seen in the steeper falling edges of the oxygen concentration on Sunday compared to the other days of the week and in the flatter rising edges of the oxygen concentration on Sunday.

To maintain the oxygen concentration in the spatial atmosphere of the enclosed room in the control range between the upper and the lower threshold under past operating procedures as depicted in FIG. 1 by means of its basic time diagram, the gas separation system is switched on and off as needed, thus operated intermittently.

In contrast thereto, the inventive solution provides for the gas separation system of the oxygen reduction system to be operated in a continuous mode of operation in which a volume of an oxygen-reduced gas mixture within a predefined or definable range is continuously provided at the outlet of the gas separation system per unit of time, wherein the volume provided per unit of time is greater than 0 liters per hour.

Figure 2:
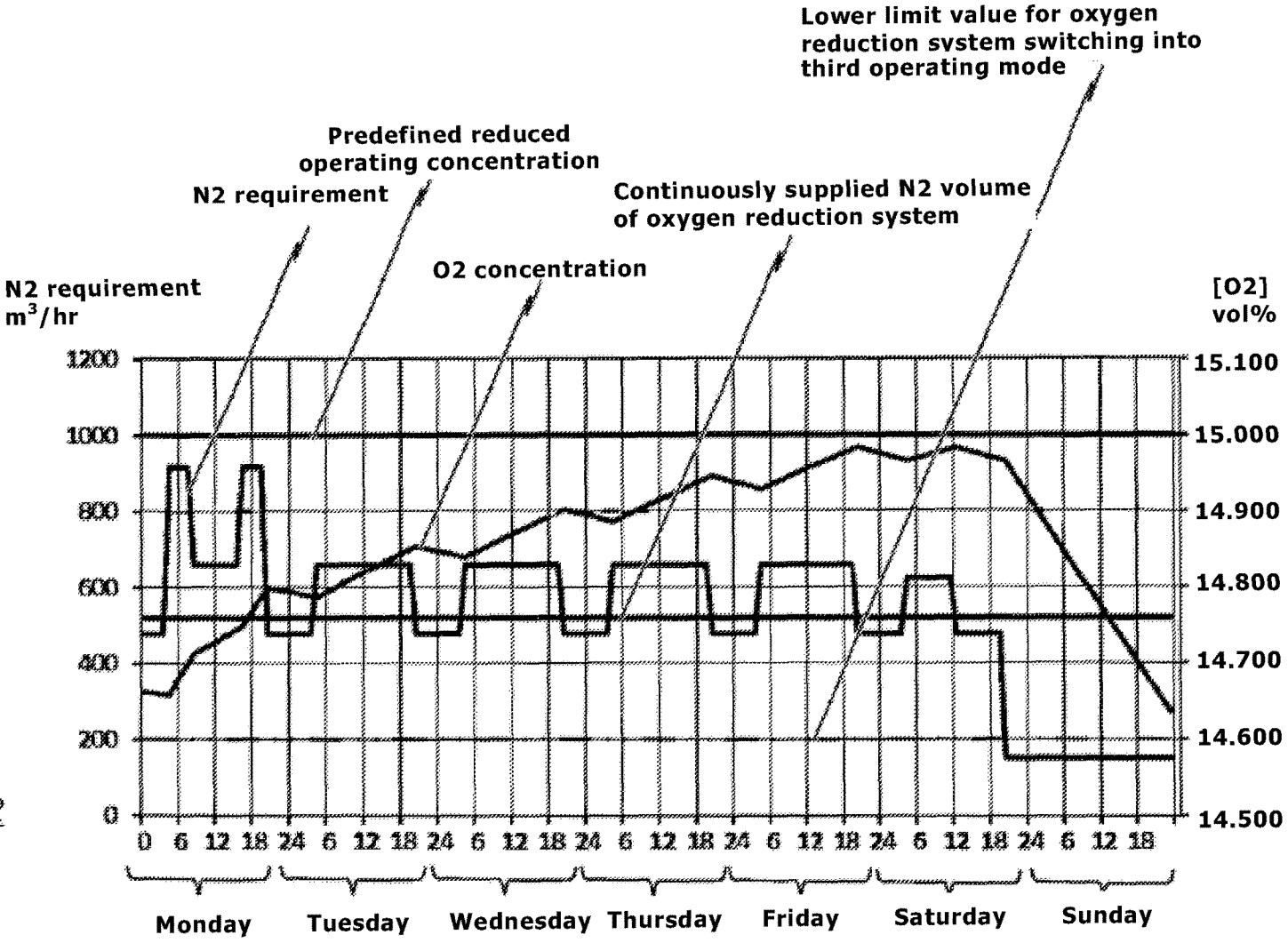
FIG. 2 a basic time diagram illustrating the mode of operation of a first example embodiment of the oxygen reduction system according to the invention.

The following will reference the basic time diagram according to FIG. 2 in describing the operating principle of an example embodiment of the inventive oxygen reduction system in greater detail.

Specifically, FIG. 2 depicts the chronological development of the oxygen concentration in the spatial atmosphere of an enclosed area for which the inventive oxygen reduction system is designed and configured. This is thereby an enclosed area (for example a warehouse) which is in use 6 days per week in three-shift operation.

The oxygen reduction system comprises a gas separation system designed and configured in consideration of a feed-dependent air exchange rate and a feed-independent air exchange rate over the course of the week. The feed-dependent air exchange rate over the course of the week thereby factors in the ingress of fresh air due to infeed and/or accessing the enclosed area.

An example of this infeed/access-dependent fresh air ingress is indicated for the first example case according to FIG. 2 in Table 1.

TABLE 1

| Weekly feed-related fresh air ingress [$m^3/h$] | | | | | | | | |
|---|---|---|---|---|---|---|---|---|
| | | Weekday | | | | | | |
| | | Mon | Tues | Wed | Thurs | Fri | Sat | Sun |
| Time of Day | 0-1 | 518 | 518 | 518 | 518 | 518 | 518 | 0 |
| | 1-2 | 518 | 518 | 518 | 518 | 518 | 518 | 0 |
| | 2-3 | 518 | 518 | 518 | 518 | 518 | 518 | 0 |
| | 3-4 | 518 | 518 | 518 | 518 | 518 | 518 | 0 |
| | 4-5 | 1210 | 806 | 806 | 806 | 806 | 749 | 0 |
| | 5-6 | 1210 | 806 | 806 | 806 | 806 | 749 | 0 |
| | 6-7 | 1210 | 806 | 806 | 806 | 806 | 749 | 0 |
| | 7-8 | 1210 | 806 | 806 | 806 | 806 | 749 | 0 |
| | 8-9 | 806 | 806 | 806 | 806 | 806 | 749 | 0 |
| | 9-10 | 806 | 806 | 806 | 806 | 806 | 749 | 0 |
| | 10-11 | 806 | 806 | 806 | 806 | 806 | 749 | 0 |
| | 11-12 | 806 | 806 | 806 | 806 | 806 | 749 | 0 |
| | 12-13 | 806 | 806 | 806 | 806 | 806 | 518 | 0 |
| | 13-14 | 806 | 806 | 806 | 806 | 806 | 518 | 0 |
| | 14-15 | 806 | 806 | 806 | 806 | 806 | 518 | 0 |
| | 15-16 | 806 | 806 | 806 | 806 | 806 | 518 | 0 |
| | 16-17 | 1210 | 806 | 806 | 806 | 806 | 518 | 0 |
| | 17-18 | 1210 | 806 | 806 | 806 | 806 | 518 | 0 |
| | 18-19 | 1210 | 806 | 806 | 806 | 806 | 518 | 0 |
| | 19-20 | 1210 | 806 | 806 | 806 | 806 | 518 | 0 |
| | 20-21 | 518 | 518 | 518 | 518 | 518 | 0 | 0 |
| | 21-22 | 518 | 518 | 518 | 518 | 518 | 0 | 0 |
| | 22-23 | 518 | 518 | 518 | 518 | 518 | 0 | 0 |
| | 23-24 | 518 | 518 | 518 | 518 | 518 | 0 | 0 |

Table 2 below, on the other hand, indicates the total fresh air ingress over the course of the week, namely for the example case according to FIG. 2. The total fresh air ingress consists of the feed-dependent air exchange rate on the one hand and the feed-independent air exchange rate at an average wind speed of 3 m/s.

TABLE 2

| Weekly total fresh air ingress [$m^3/h$] | | | | | | | | |
|---|---|---|---|---|---|---|---|---|
| | | Weekday | | | | | | |
| | | Mon | Tues | Wed | Thurs | Fri | Sat | Sun |
| Time of Day | 0-1 | 758 | 758 | 758 | 758 | 758 | 758 | 240 |
| | 1-2 | 758 | 758 | 758 | 758 | 758 | 758 | 240 |
| | 2-3 | 758 | 758 | 758 | 758 | 758 | 758 | 240 |
| | 3-4 | 758 | 758 | 758 | 758 | 758 | 758 | 240 |
| | 4-5 | 1450 | 1046 | 1046 | 1046 | 1046 | 989 | 240 |

TABLE 2-continued

| Weekly total fresh air ingress [$m^3/h$] | | | | | | | | |
|---|---|---|---|---|---|---|---|---|
| | | Weekday | | | | | | |
| | | Mon | Tues | Wed | Thurs | Fri | Sat | Sun |
| | 5-6 | 1450 | 1046 | 1046 | 1046 | 1046 | 989 | 240 |
| | 6-7 | 1450 | 1046 | 1046 | 1046 | 1046 | 989 | 240 |
| | 7-8 | 1450 | 1046 | 1046 | 1046 | 1046 | 989 | 240 |
| | 8-9 | 1046 | 1046 | 1046 | 1046 | 1046 | 989 | 240 |
| | 9-10 | 1046 | 1046 | 1046 | 1046 | 1046 | 989 | 240 |
| | 10-11 | 1046 | 1046 | 1046 | 1046 | 1046 | 989 | 240 |
| | 11-12 | 1046 | 1046 | 1046 | 1046 | 1046 | 989 | 240 |
| | 12-13 | 1046 | 1046 | 1046 | 1046 | 1046 | 758 | 240 |
| | 13-14 | 1046 | 1046 | 1046 | 1046 | 1046 | 758 | 240 |
| | 14-15 | 1046 | 1046 | 1046 | 1046 | 1046 | 758 | 240 |
| | 15-16 | 1046 | 1046 | 1046 | 1046 | 1046 | 758 | 240 |
| | 16-17 | 1450 | 1046 | 1046 | 1046 | 1046 | 758 | 240 |
| | 17-18 | 1450 | 1046 | 1046 | 1046 | 1046 | 758 | 240 |
| | 18-19 | 1450 | 1046 | 1046 | 1046 | 1046 | 758 | 240 |
| | 19-20 | 1450 | 1046 | 1046 | 1046 | 1046 | 758 | 240 |
| | 20-21 | 758 | 758 | 758 | 758 | 758 | 240 | 240 |
| | 21-22 | 758 | 758 | 758 | 758 | 758 | 240 | 240 |
| | 22-23 | 758 | 758 | 758 | 758 | 758 | 240 | 240 |
| | 23-24 | 758 | 758 | 758 | 758 | 758 | 240 | 240 |

In order to be able to maintain the oxygen content below a predefined and reduced operating concentration compared to the oxygen concentration of the normal ambient air in the spatial atmosphere of the enclosed area, it is necessary to supply an oxygen-reduced gas mixture or an oxygen-displacing gas respectively so as to at least partially offset the total ingress of fresh air over time.

In the example embodiment considered here, nitrogen ($N_2$) having a residual oxygen concentration of e.g. 5% is used as the oxygen-reduced gas mixture/oxygen-displacing gas. The resulting nitrogen needed to offset the total fresh air ingress over the course of the week is summarized in Table 3.

TABLE 3

| Weekly nitrogen requirement [$m^3/h$] | | | | | | | | |
|---|---|---|---|---|---|---|---|---|
| | | Weekday | | | | | | |
| | | Mon | Tues | Wed | Thurs | Fri | Sat | Sun |
| Time of Day | 0-1 | 454 | 454 | 454 | 454 | 454 | 454 | 144 |
| | 1-2 | 454 | 454 | 454 | 454 | 454 | 454 | 144 |
| | 2-3 | 454 | 454 | 454 | 454 | 454 | 454 | 144 |
| | 3-4 | 454 | 454 | 454 | 454 | 454 | 454 | 144 |
| | 4-5 | 867 | 626 | 626 | 626 | 626 | 591 | 144 |
| | 5-6 | 867 | 626 | 626 | 626 | 626 | 591 | 144 |
| | 6-7 | 867 | 626 | 626 | 626 | 626 | 591 | 144 |
| | 7-8 | 867 | 626 | 626 | 626 | 626 | 591 | 144 |
| | 8-9 | 626 | 626 | 626 | 626 | 626 | 591 | 144 |
| | 9-10 | 626 | 626 | 626 | 626 | 626 | 591 | 144 |
| | 10-11 | 626 | 626 | 626 | 626 | 626 | 591 | 144 |
| | 11-12 | 626 | 626 | 626 | 626 | 626 | 591 | 144 |
| | 12-13 | 626 | 626 | 626 | 626 | 626 | 454 | 144 |
| | 13-14 | 626 | 626 | 626 | 626 | 626 | 454 | 144 |
| | 14-15 | 626 | 626 | 626 | 626 | 626 | 454 | 144 |
| | 15-16 | 626 | 626 | 626 | 626 | 626 | 454 | 144 |
| | 16-17 | 867 | 626 | 626 | 626 | 626 | 454 | 144 |
| | 17-18 | 867 | 626 | 626 | 626 | 626 | 454 | 144 |
| | 18-19 | 867 | 626 | 626 | 626 | 626 | 454 | 144 |
| | 19-20 | 867 | 626 | 626 | 626 | 626 | 454 | 144 |
| | 20-21 | 454 | 454 | 454 | 454 | 454 | 144 | 144 |
| | 21-22 | 454 | 454 | 454 | 454 | 454 | 144 | 144 |
| | 22-23 | 454 | 454 | 454 | 454 | 454 | 144 | 144 |
| | 23-24 | 454 | 454 | 454 | 454 | 454 | 144 | 144 |

The chronological development of the nitrogen requirement is likewise plotted in the FIG. 2 time diagram. Particularly to be recognized there is that on Sunday (off-day), the nitrogen requirement drops to a relatively low value of 144 $m^3$/h. This reduced nitrogen need results from the reduced air exchange rate on Sunday since the air exchange rate on Sunday is dictated by the feed-independent air exchange rate (the feed-dependent air exchange rate being negligible on the off day since no infeed and/or accessing of the enclosed area is anticipated on the off day).

As of Monday, however, the feed-dependent air exchange rate is considerably increased as increased pallet movement and thus infeed occurs at the start of or respectively during a work week. Correspondingly, the nitrogen requirement also increases accordingly as of Monday.

Unlike the conventional know prior art mode of operation, the present invention provides for the gas separation system of the oxygen reduction system to be operated continuously, whereby continuously in this context in particular also means Sunday (off-day) operation. The operating mode of the gas separation system is thereby selected so as to continuously have a volume of an oxygen-reduced gas mixture provided at the outlet of the gas separation system per unit of time such that the oxygen concentration in the spatial atmosphere of the enclosed area lies within a range between the predefined reduced operating concentration and a predefined or definable lower limit concentration throughout the entire week cycle. In other words, a calculated nitrogen buffer builds up within the enclosed area during the off-times from the continuous operation of the gas separation system which is then used for a subsequent period of increased nitrogen requirement.

In the time diagram shown in FIG. 2, the predefined reduced operating concentration amounts to 15% by volume and the predefined or definable lower limit concentration amounts to 14.6% by volume. However, other concentration values are of course also conceivable.

Specifically, and as can be noted from the time diagram according to FIG. 2, the gas separation system of the oxygen reduction system can be continuously operated such that 526 $m^3$ of oxygen-reduced gas mixture can be continuously provided per hour at the outlet of the gas separation system. This operating mode of the gas separation system ensures that the oxygen concentration in the spatial atmosphere of the enclosed area always lies below the predefined reduced operating concentration of 15% by volume over the week cycle.

Compared to a conventionally designed and/or configured oxygen reduction system, however, the inventive solution enables a clearly smaller dimensioning of the gas separation system. It is hereby to be considered that the example case of the gas separation system depicted in FIG. 1 is configured for a delivery capacity of more than 1000 $m^3$/h.

Figure 3:
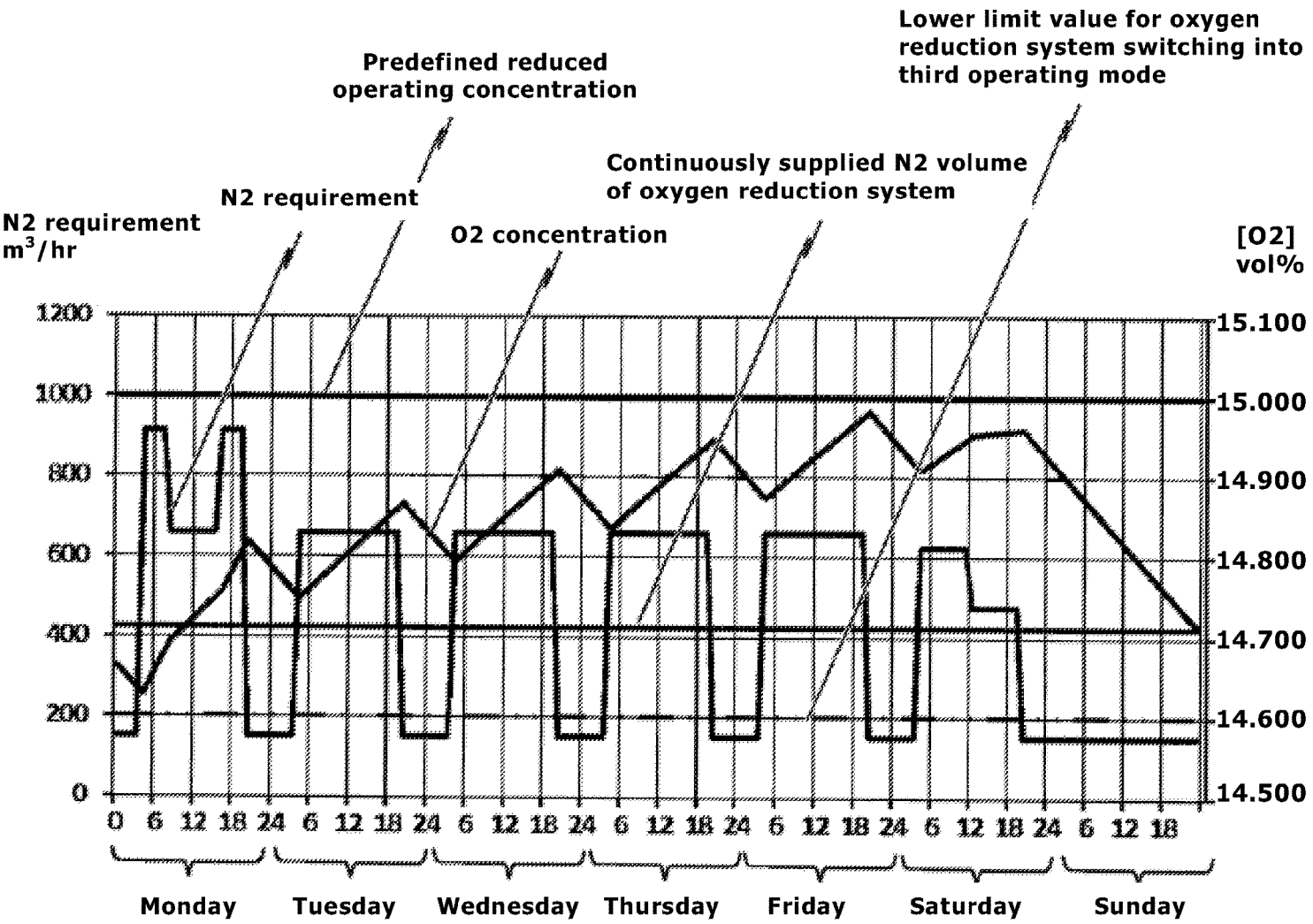
FIG. 3 a basic time diagram illustrating the mode of operation of a second example embodiment of the oxygen reduction system according to the invention.

The following will reference the basic time diagram according to FIG. 3 in describing a further example embodiment of the present invention. Specifically illustrated therein is the mode of operation of an oxygen reduction system which is designed and configured for an enclosed area (warehouse) which is operated 6 days per week in a two-shift operation. As with the example case depicted in FIG. 2, Sunday is also an off day in the time diagram according to FIG. 3.

Since—in contrast to the situation shown in FIG. 2—the enclosed area (warehouse) is in two-shift operational use in the example case of FIG. 3, the feed-dependent air exchange rate of the enclosed area over the course of the week differs from the feed-dependent air exchange rate considered in the example case of FIG. 2.

Specifically, the infeed and/or access-dependent fresh air ingress over the course of the week for the FIG. 3 example case is summarized in Table 4.

TABLE 4

Weekly feed-related fresh air ingress [$m^3$/h]

| | | Weekday | | | | | | |
|---|---|---|---|---|---|---|---|---|
| | | Mon | Tues | Wed | Thurs | Fri | Sat | Sun |
| Time of Day | 0-1 | 0 | 0 | 0 | 0 | 0 | 0 | 0 |
| | 1-2 | 0 | 0 | 0 | 0 | 0 | 0 | 0 |
| | 2-3 | 0 | 0 | 0 | 0 | 0 | 0 | 0 |
| | 3-4 | 0 | 0 | 0 | 0 | 0 | 0 | 0 |
| | 4-5 | 1210 | 806 | 806 | 806 | 806 | 749 | 0 |
| | 5-6 | 1210 | 806 | 806 | 806 | 806 | 749 | 0 |
| | 6-7 | 1210 | 806 | 806 | 806 | 806 | 749 | 0 |
| | 7-8 | 1210 | 806 | 806 | 806 | 806 | 749 | 0 |
| | 8-9 | 806 | 806 | 806 | 806 | 806 | 749 | 0 |
| | 9-10 | 806 | 806 | 806 | 806 | 806 | 749 | 0 |
| | 10-11 | 806 | 806 | 806 | 806 | 806 | 749 | 0 |
| | 11-12 | 806 | 806 | 806 | 806 | 806 | 749 | 0 |
| | 12-13 | 806 | 806 | 806 | 806 | 806 | 518 | 0 |
| | 13-14 | 806 | 806 | 806 | 806 | 806 | 518 | 0 |
| | 14-15 | 806 | 806 | 806 | 806 | 806 | 518 | 0 |
| | 15-16 | 806 | 806 | 806 | 806 | 806 | 518 | 0 |
| | 16-17 | 1210 | 806 | 806 | 806 | 806 | 518 | 0 |
| | 17-18 | 1210 | 806 | 806 | 806 | 806 | 518 | 0 |
| | 18-19 | 1210 | 806 | 806 | 806 | 806 | 518 | 0 |
| | 19-20 | 1210 | 806 | 806 | 806 | 806 | 518 | 0 |
| | 20-21 | 0 | 0 | 0 | 0 | 0 | 0 | 0 |
| | 21-22 | 0 | 0 | 0 | 0 | 0 | 0 | 0 |
| | 22-23 | 0 | 0 | 0 | 0 | 0 | 0 | 0 |
| | 23-24 | 0 | 0 | 0 | 0 | 0 | 0 | 0 |

The total fresh air ingress over the course of the week for the FIG. 3 example case is summarized in Table 5.

TABLE 5

Weekly total fresh air ingress [$m^3$/h]

| | | Weekday | | | | | | |
|---|---|---|---|---|---|---|---|---|
| | | Mon | Tues | Wed | Thurs | Fri | Sat | Sun |
| Time of Day | 0-1 | 240 | 240 | 240 | 240 | 240 | 240 | 240 |
| | 1-2 | 240 | 240 | 240 | 240 | 240 | 240 | 240 |
| | 2-3 | 240 | 240 | 240 | 240 | 240 | 240 | 240 |
| | 3-4 | 240 | 240 | 240 | 240 | 240 | 240 | 240 |
| | 4-5 | 1450 | 1046 | 1046 | 1046 | 1046 | 989 | 240 |
| | 5-6 | 1450 | 1046 | 1046 | 1046 | 1046 | 989 | 240 |
| | 6-7 | 1450 | 1046 | 1046 | 1046 | 1046 | 989 | 240 |
| | 7-8 | 1450 | 1046 | 1046 | 1046 | 1046 | 989 | 240 |
| | 8-9 | 1046 | 1046 | 1046 | 1046 | 1046 | 989 | 240 |
| | 9-10 | 1046 | 1046 | 1046 | 1046 | 1046 | 989 | 240 |
| | 10-11 | 1046 | 1046 | 1046 | 1046 | 1046 | 989 | 240 |
| | 11-12 | 1046 | 1046 | 1046 | 1046 | 1046 | 989 | 240 |
| | 12-13 | 1046 | 1046 | 1046 | 1046 | 1046 | 758 | 240 |
| | 13-14 | 1046 | 1046 | 1046 | 1046 | 1046 | 758 | 240 |
| | 14-15 | 1046 | 1046 | 1046 | 1046 | 1046 | 758 | 240 |
| | 15-16 | 1046 | 1046 | 1046 | 1046 | 1046 | 758 | 240 |
| | 16-17 | 1450 | 1046 | 1046 | 1046 | 1046 | 758 | 240 |
| | 17-18 | 1450 | 1046 | 1046 | 1046 | 1046 | 758 | 240 |
| | 18-19 | 1450 | 1046 | 1046 | 1046 | 1046 | 758 | 240 |
| | 19-20 | 1450 | 1046 | 1046 | 1046 | 1046 | 758 | 240 |
| | 20-21 | 240 | 240 | 240 | 240 | 240 | 240 | 240 |
| | 21-22 | 240 | 240 | 240 | 240 | 240 | 240 | 240 |
| | 22-23 | 240 | 240 | 240 | 240 | 240 | 240 | 240 |
| | 23-24 | 240 | 240 | 240 | 240 | 240 | 240 | 240 |

The resultant nitrogen requirement is summarized in Table 6.

TABLE 6

| Weekly nitrogen requirement [m³/h] | | | | | | | | |
|---|---|---|---|---|---|---|---|---|
| | | Weekday | | | | | | |
| | | Mon | Tues | Wed | Thurs | Fri | Sat | Sun |
| Time of Day | 0-1 | 144 | 144 | 144 | 144 | 144 | 144 | 144 |
| | 1-2 | 144 | 144 | 144 | 144 | 144 | 144 | 144 |
| | 2-3 | 144 | 144 | 144 | 144 | 144 | 144 | 144 |
| | 3-4 | 144 | 144 | 144 | 144 | 144 | 144 | 144 |
| | 4-5 | 867 | 626 | 626 | 626 | 626 | 591 | 144 |
| | 5-6 | 867 | 626 | 626 | 626 | 626 | 591 | 144 |
| | 6-7 | 867 | 626 | 626 | 626 | 626 | 591 | 144 |
| | 7-8 | 867 | 626 | 626 | 626 | 626 | 591 | 144 |
| | 8-9 | 626 | 626 | 626 | 626 | 626 | 591 | 144 |
| | 9-10 | 626 | 626 | 626 | 626 | 626 | 591 | 144 |
| | 10-11 | 626 | 626 | 626 | 626 | 626 | 591 | 144 |
| | 11-12 | 626 | 626 | 626 | 626 | 626 | 591 | 144 |
| | 12-13 | 626 | 626 | 626 | 626 | 626 | 454 | 144 |
| | 13-14 | 626 | 626 | 626 | 626 | 626 | 454 | 144 |
| | 14-15 | 626 | 626 | 626 | 626 | 626 | 454 | 144 |
| | 15-16 | 626 | 626 | 626 | 626 | 626 | 454 | 144 |
| | 16-17 | 867 | 626 | 626 | 626 | 626 | 454 | 144 |
| | 17-18 | 867 | 626 | 626 | 626 | 626 | 454 | 144 |
| | 18-19 | 867 | 626 | 626 | 626 | 626 | 454 | 144 |
| | 19-20 | 867 | 626 | 626 | 626 | 626 | 454 | 144 |
| | 20-21 | 144 | 144 | 144 | 144 | 144 | 144 | 144 |
| | 21-22 | 144 | 144 | 144 | 144 | 144 | 144 | 144 |
| | 22-23 | 144 | 144 | 144 | 144 | 144 | 144 | 144 |
| | 23-24 | 144 | 144 | 144 | 144 | 144 | 144 | 144 |

The chronological development of the nitrogen requirement is likewise plotted in the time diagram according to FIG. 3.

Compared to the situation depicted in FIG. 2 in which a three-shift operation was considered, the infeed and/or access-dependent fresh air ingress rate is, as expected, lower in the example case according to FIG. 3. This has the consequence of being able to reduce the volume of oxygen-reduced gas mixture continuously provided per unit of time by the gas separation system in the example case according to FIG. 3.

Specifically, in the example case according to FIG. 3, it suffices for the gas separation system to supply 424 $m^3$ of nitrogen per hour in order to ensure that the oxygen concentration in the spatial atmosphere of the enclosed area always remains below the predefined operating concentration of 15% by volume over the course of the week.

The time diagrams of the example cases according to FIG. 2 and FIG. 3 show that a sufficient volume of an oxygen-reduced gas mixture is (continuously) provided per unit of time in continuous operation of the gas separation system of the oxygen reduction system for that the oxygen concentration in the spatial atmosphere of the enclosed area to always remain below the predefined reduced operating concentration and a predefined or definable lower limit concentration.

In the example cases, the predefined operating concentration is 15% by volume while the predefined or definable lower limit concentration is at most 1% oxygen by volume and preferentially no more than 0.5% oxygen by volume below the predefined reduced operating concentration in terms of the oxygen content.

Further learned from the time diagrams according to FIGS. 2 and 3 is that the total air exchange rate of the enclosed area varies cyclically with regard to time (here: within the week cycle), whereby each time cycle is divided into multiple consecutive time periods, and whereby for each time period, an average total air exchange rate of the enclosed area assumes a respective corresponding value. Reference is made in this context to the Table 2 items for the example case per FIG. 2 and to Table 5 respectively for the example case per FIG. 3.

The respective duration of the time cycle periods and the respective average total air exchange rate for each time period then plays a role in the design/configuration of the gas separation system of the oxygen reduction system. As stated above, in the example case according to FIG. 2, by virtue of the three-shift operation considered therein, the feed-dependent air exchange rate is higher at least on the weekdays from Monday to Saturday compared to the situation in the example case according to FIG. 3. As a consequence, the gas separation system needs to provide a larger volume of an oxygen-displacing gas mixture (nitrogen) per unit of time in the FIG. 2 example case in comparison to the gas separation system used in the example case according to FIG. 3.

The invention is not limited to the example cases described with reference to the time diagrams according to FIG. 2 and FIG. 3. In particular, the inventive solution is in general suited to an enclosed area with a cyclically varying total air exchange rate over time, whereby each time cycle is divided into a plurality of consecutive time periods, and whereby an average total air exchange rate of the enclosed area assumes a respective corresponding value for each time period.

For example, it is conceivable in this context for the average air exchange rate of the enclosed area to be within a first range of values during a first time period of the plurality of consecutive time periods of a time cycle and for the average air exchange rate of the enclosed area to be within at least one second range of values during a second time period of the plurality of consecutive time periods of the time cycle, wherein the average value of the at least one second range of values is greater than the average value of the first range of values. It is preferential in this case for the gas separation system of the oxygen reduction system to be configured in consideration of the length of time of the first and the at least one second time period as well as in consideration of the average total air exchange rate of the enclosed area during the first and the at least one second time period such that the oxygen concentration in the spatial atmosphere of the enclosed area always lies in a range between the predefined operating concentration and the predefined or definable lower limit concentration during a continuous operation of the gas separation system in the first operating mode.

The example cases described with reference to the time diagrams of FIGS. 2 and 3 allow for a maximum average wind speed of 3.0 m/s. This condition may not always exist in reality. At least temporarily much higher wind speeds can in particular not be excluded. That would then in particular have an impact on the feed-independent air exchange rate; i.e. the air exchange rate due to unintended or unavoidable leakages in the spatial shell of the enclosed area.

In order for the inventive oxygen reduction system to also be able to maintain a reduced oxygen concentration in the spatial atmosphere of the enclosed area below a predefined operating concentration in such exceptional cases, the gas separation system can be operated in at least two different operating modes in an advantageous further development of the inventive oxygen reduction system. Starting from its standard operating mode (first operating mode), the gas separation system is thereby operated in its second operating mode when the average total air exchange rate of the enclosed area increases, particularly in unforeseeable and particularly non-cyclical manner.

Compared to the first operating mode, the volume of oxygen-reduced gas mixture continuously provided at the outlet of the gas separation system per unit of time is increased accordingly—in relation to a reference value of a residual oxygen concentration—in the second operating mode of the gas separation system. On the other hand, the specific output of the gas separation system is lower in the first operating mode of the gas separation system than the specific output of the gas separation system in the second operating mode.

The term "specific output of the gas separation system" used herein refers to the specific energy requirement of the gas separation system (at a reference temperature of e.g. 20° C.) in providing a unit of volume of the oxygen-reduced gas mixture (in relation to a reference value of a residual oxygen concentration).

It is for example conceivable in this context for the gas separation system of the oxygen reduction system to be configured so as to be operable in either a VPSA mode or a PSA mode, wherein the first operating mode of the gas separation system corresponds to the VPSA mode and the second operating mode of the gas separation system corresponds to the PSA mode.

A gas separation system operated in VPSA mode generally refers to a system for providing nitrogen-enriched air which works according to the principle of vacuum pressure swing adsorption (VPSA). According to one aspect of the present invention, such a VPSA system is employed in the oxygen reduction system as the gas separation system which can, however, be operated in a PSA mode when necessary, particularly when the average total air exchange rate of the enclosed area increases in unforeseeable and/or non-cyclical manner. The abbreviation "PSA" stands for "pressure swing adsorption," which is usually referred to as "pressure swing adsorption technique".

In order to be able to switch the operating mode of the gas separation system used in this first aspect of the present invention from VPSA to PSA, one preferential implementation of the inventive oxygen reduction system provides for first providing an initial gas mixture containing oxygen, nitrogen and any further components as applicable. The initial gas mixture provided is suitably compressed and at least a portion of the oxygen contained in the compressed initial gas mixture is removed in the gas separation system so that a nitrogen-enriched gas mixture is provided at the outlet of the gas separation system. This nitrogen-enriched gas mixture at the outlet of the gas separation system thereby corresponds to the oxygen-reduced gas mixture continuously fed into the spatial atmosphere of the enclosed area.

Provided according to a further aspect of the present invention is increasing the degree of compression of the initial gas mixture as realized by the compressor system when the gas separation system needs to be switched from the first operating mode into the second operating mode due to an increased exchange of air. In one example embodiment, it is conceivable in this context for the degree of compression to be increased from an original 1.5-2.0 bar to 7.0-9.0 bar. In other embodiments, increasing the compression up to 25.0 bar is conceivable. The invention is in particular not limited to the above-specified example values.

According to one aspect of the present invention, it is provided for the gas separation system to be operated in the second operating mode when the oxygen concentration within the enclosed area exceeds a predefined or definable upper limit value—in particular due to an increased average air exchange rate over time—wherein said predefined or definable upper oxygen concentration limit value preferably corresponds to an oxygen concentration at or above the oxygen concentration corresponding to the predefined operating concentration. The predefined or definable upper oxygen concentration limit value preferably corresponds to an oxygen concentration at a maximum of 1.0% by volume and preferably at a maximum of 0.2% by volume above the oxygen concentration corresponding to the predefined operating concentration.

In conjunction hereto, it is in particular also conceivable for the gas separation system to be operable at least at two different predefined output levels in the second operating mode, wherein the at least two output levels differ in that the volume of oxygen-reduced gas mixture able to be provided by the gas separation system per unit of time is higher at a second output level—compared to a first output level—and that in relation to a predefined residual oxygen concentration reference value. It is hereby advantageous for the output level of the gas separation system to preferably be automatically selected in the second operating mode as a function of the degree to which the predefined or definable upper oxygen concentration limit value is exceeded.

Alternatively or additionally thereto, it is further conceivable to provide a further source of inert gas independent of the gas separation system, in particular in the form of a compressed gas tank in which an oxygen-reduced gas mixture or inert gas is stored in compressed form. The further inert gas source is then fluidly connected to the enclosed area when the oxygen concentration within the enclosed area exceeds—in particular due to an increased average air exchange rate over time—a predefined or definable upper limit value. Here as well, the predefined or definable upper limit value preferably corresponds to an oxygen concentration at or above the oxygen concentration corresponding to the predefined operating concentration. The predefined or definable upper limit value thereby preferably corresponds to an oxygen concentration at a maximum of 1.0% by volume and preferably at a maximum of 0.2% by volume above the oxygen concentration corresponding to the operating concentration.

According to a further aspect of the invention, a device is further provided for the as-needed reducing of a feed-dependent air exchange rate of the enclosed area, whereby the feed-dependent air exchange rate factors in an exchange of air caused by openings which can be formed as needed in the spatial shell of the enclosed room for infeed and/or access purposes. Said device is designed to preferably automatically reduce the feed-dependent air exchange rate of the enclosed area when the oxygen concentration within the enclosed area exceeds a predefined or definable upper limit value. The predefined or definable upper limit value preferably corresponds to an oxygen concentration at or above the oxygen concentration corresponding to the predefined operating concentration.

It is therefore conceivable for suitable feed management to at least intermittently reduce the feed-dependent air exchange rate, and thus also the total air exchange rate. Hereby conceivable is for example the feed management only allowing a limited number of doors or gates to be opened and/or limiting the open periods.

According to a further aspect of the present invention, it is provided for the gas separation system to be further operable in a third operating mode in which the volume of an oxygen-reduced gas mixture continuously provided at the outlet per unit of time is reduced—relative to a reference value of a residual oxygen concentration—compared to the first operating mode. The specific output of the gas separation system in the first operating mode is thereby to be higher than the specific output of the gas separation system in the third operating mode.

Particularly conceivable in this context is for the gas separation system to be operated in the third operating mode when the oxygen concentration within the enclosed area falls below a predefinable lower limit value—particularly due to a reduced average total air exchange rate over time. This predefinable lower limit value corresponds in particular to an oxygen concentration at or above the oxygen concentration corresponding to the predefinable lower limit concentration or higher than the predefinable lower limit concentration.

It is however also conceivable for the gas separation system to comprise a plurality of nitrogen generators operable in parallel for operating the gas separation system in the different operating modes, whereby said nitrogen generators are switched on or off as needed.

In short, the present invention relates in particular to a system for maintaining a reduced oxygen content in the spatial atmosphere of an enclosed area below a predefined and reduced operating concentration compared to the oxygen concentration of the normal ambient air, wherein the system comprises a continuously operated gas separation system configured such that when the gas separation system is in continuous operation, the oxygen concentration in the spatial atmosphere of the enclosed area always remains within a range between the predefined operating concentration and a predefined or definable lower limit concentration.

The oxygen reduction system is preferably assigned to an enclosed area which has a total air exchange rate that varies cyclically over time, whereby each time cycle is divided into multiple consecutive time periods, and whereby an average total air exchange rate of the enclosed area assumes a respective corresponding value for each time period. The gas separation system is thereby configured in consideration of the respective length of the time periods as well as in consideration of the respective average total air exchange rates such that the oxygen concentration in the spatial atmosphere of the enclosed area always lies in a range between the predefined operating concentration and the predefined or definable lower limit concentration when the gas separation system is in continuous operation.

In a particularly preferential implementation, the time cycle is a weekly cycle, wherein the average total air exchange rate of the enclosed area continuously corresponds to an feed-independent air exchange rate of the enclosed area during at least one first time period of preferably at least 4 to 48 hours, in particular of at least 4 to 24 hours, and even more preferentially of at least 6 to 24 hours, and wherein the average total air exchange rate of the enclosed area during the remaining time of the weekly cycle corresponds to a sum, in particular a weighted sum, of a feed-dependent air exchange rate and a feed-independent air exchange rate.

The gas separation system of the inventive oxygen reduction system is thereby configured such that in continuous gas separation system operation, the oxygen concentration in the spatial atmosphere of the enclosed area is reduced in such a manner during the at least one first time period that neither during the rest of the time of the weekly cycle will the oxygen concentration in the spatial atmosphere of the enclosed area exceed the design concentration. From a descriptive perspective, the oxygen reduction system is thus configured such that during a calculated off-time of lower air exchange rate, a nitrogen buffer builds up in the enclosed area. This buffer then offsets the higher air exchange rate during operating times so that the oxygen reduction system does not have to effect the offsetting and can be operated consistently.

The invention is not limited to the described example cases but rather yields from an integrated consideration of all the features disclosed herein in context.

The invention claimed is:

1. A system for reducing an oxygen concentration in a spatial atmosphere of an enclosed area and/or maintaining a reduced oxygen content in the spatial atmosphere of the enclosed area below a predefined operating concentration and a reduced operating concentration in comparison to an oxygen concentration of normal ambient air, wherein the system comprises:

a gas separation system, an outlet of the gas separation system fluidly connected to the enclosed area to continuously supply an oxygen-reduced gas mixture or an oxygen-displacing gas, wherein the gas separation system is configured such that the oxygen concentration in the spatial atmosphere of the enclosed area always remains in a range between the predefined operating concentration and a predefined lower limit concentration or a definable lower limit concentration during a continuous operation of the gas separation system in a first operating mode in which a volume of the oxygen-reduced gas mixture within a predefined range or a definable range is continuously provided at the outlet of the gas separation system per unit of time, wherein a total air exchange rate of the enclosed area varies cyclically over time, wherein each time cycle is divided into a plurality of consecutive time periods, and wherein for each of the time periods, an average total air exchange rate of the enclosed area assumes a respective corresponding value, wherein the gas separation system is configured in consideration of a respective length of the time periods as well as in consideration of the respective average total air exchange rate such that the oxygen concentration in the spatial atmosphere of the enclosed area is always within a range between the predefined operating concentration and the predefined lower limit concentration or the definable lower limit concentration during the continuous operation of the gas separation system in the first operating mode.

2. The system according to claim 1, wherein the average total air exchange rate of the enclosed area is within a first range of values during a first time period of the plurality of consecutive time periods of the time cycle, and wherein the average total air exchange rate of the enclosed area is within at least one second range of values during at least one second time period of the plurality of consecutive time periods of the time cycle, wherein an average value of the at least one second range of values is greater than an average value of the first range of values, and wherein the gas separation system is configured in consideration of a length of time of the first time period and a length of time of the at least one second time period as well as in consideration of the average total air exchange rate of the enclosed area during the first time period and the at least one second time period such that the oxygen concentration in the spatial atmosphere of the enclosed area always lies in a range between the predefined operating concentration and the predefined lower limit concentration during the continuous operation of the gas separation system in the first operating mode.

3. The system according to claim 1, wherein the volume of the oxygen-reduced gas mixture continuously provided at the outlet of the gas separation system per unit of time when the gas separation system is in the continuous operation in the first operating mode is selected as a function of at least one of a parameters from:

a spatial volume of the enclosed area;

a feed-independent air exchange rate through leakages in a spatial shell of the enclosed area; and/or a feed-dependent air exchange rate due to openings which can be formed as needed in the spatial shell of the enclosed area for infeed and/or access purposes.

4. The system according claim 1, wherein the time cycle is a weekly cycle, and wherein the average total air exchange rate of the enclosed area continuously corresponds to a feed-independent air exchange rate of the enclosed area during at least one first time period of at least 4 to 48 hours, and wherein the average total air exchange rate of the enclosed area during a remaining time of the weekly cycle corresponds to a sum, of a feed-dependent air exchange rate and a feed-independent air exchange rate, wherein the gas separation system is configured such that in a continuous gas separation system operating in the first operating mode, the oxygen concentration in the spatial atmosphere of the enclosed area is reduced in such a manner during the at least one first time period that the oxygen concentration in the spatial atmosphere of the enclosed area will also not exceed an operating concentration during a remainder of the time of the weekly cycle.

5. The system according to claim 1, wherein the gas separation system is further operable in a second operating mode in which the volume of the oxygen-reduced gas mixture provided continuously at the outlet per unit of time is increased in comparison to the first operating mode relative to a reference value of a residual oxygen concentration, wherein a specific output of the gas separation system is lower in the first operating mode than a specific output of the gas separation system in the second operating mode.

6. The system according to claim 5, wherein the gas separation system is configured to be operable in either a VPSA mode or a PSA mode, and wherein the first operating mode of the gas separation system corresponds to the VPSA mode and the second operating mode of the gas separation system corresponds to the PSA mode.

7. The system according to claim 1, wherein a further inert gas source independent of the gas separation system is provided, in particular in the form of a compressed gas tank in which an oxygen-reduced gas mixture or an inert gas is stored in compressed form, wherein the further inert gas source is fluidly connected to the enclosed area when the oxygen concentration in the spatial atmosphere of the enclosed area exceeds in particular due to an increased average air exchange rate over time a predefined upper limit value or a definable upper limit value, wherein the predefined upper limit value or the definable upper limit value of the oxygen concentration corresponds to an oxygen concentration at or above an oxygen concentration corresponding to the predefined operating concentration, and wherein a predefined upper oxygen concentration limit value or a definable upper oxygen concentration limit value corresponds to an oxygen concentration at a maximum of 1.0% by volume above the oxygen concentration corresponding to the predefined operating concentration.

8. The system according to claim 1, wherein a device is provided for the as-needed reducing of a feed-dependent air exchange rate of the enclosed area, wherein the feed-dependent air exchange rate factors in an exchange of air due to openings which can be formed as needed in a spatial shell of the enclosed room for infeed and/or access purposes, wherein the device automatically reduces the feed-dependent air exchange rate of the enclosed area when the oxygen concentration in the enclosed area exceeds a predefined upper limit value or a definable upper limit value, wherein a predefined upper oxygen concentration limit value or a definable upper oxygen concentration limit value corresponds to an oxygen concentration at or above the oxygen concentration corresponding to the predefined operating concentration, and wherein the predefined upper oxygen concentration limit value or the definable upper oxygen concentration limit value corresponds to an oxygen concentration at a maximum of 1.0% by volume above the oxygen concentration corresponding to the predefined operating concentration.

9. The system according to claim 1, wherein the predefined operating concentration corresponds to a design concentration; and/or wherein the predefined lower limit concentration or the definable lower limit concentration is at most 3% oxygen by volume below the predefined operating concentration in terms of oxygen content; and/or wherein the gas separation system comprises a plurality of nitrogen generators operable in parallel.

10. A method for configuring an oxygen reduction system for an enclosed area, wherein the method comprises steps of:

dividing a predefined time cycle into a plurality of consecutive time periods;

establishing an average total air exchange rate of the enclosed area for each of the time periods;

weighting the established average total air exchange rate in terms of respective durations of the corresponding time periods; and adapting and/or selecting a gas separation system of the oxygen reduction system in consideration of weighted average total air exchange rates of the enclosed area such that an oxygen concentration in a spatial atmosphere of the enclosed area always remains within a range between a predefined operating concentration and a predefinable lower limit concentration when the gas separation system is continuously operated in a first operating mode in which a volume of an oxygen-reduced gas mixture or an oxygen-displacing gas within a predefined range or a definable range is continuously provided at an outlet of the gas separation system per unit of time.

11. A system for reducing an oxygen concentration in a spatial atmosphere of an enclosed area and/or maintaining a reduced oxygen content in the spatial atmosphere of the enclosed area below a predefined operating concentration and a reduced operating concentration in comparison to an oxygen concentration of normal ambient air, wherein the system comprises:

a gas separation system, an outlet of the gas separation system fluidly connected to the enclosed area to continuously supply an oxygen-reduced gas mixture or an oxygen-displacing gas, wherein the gas separation system is configured such that the oxygen concentration in the spatial atmosphere of the enclosed area always remains in a range between the predefined operating concentration and a predefined lower limit concentration or a definable lower limit concentration during a continuous operation of the gas separation system in a first operating mode in which a volume of the oxygen-reduced gas mixture within a predefined range or a definable range is continuously provided at the outlet of the gas separation system per unit of time, wherein the gas separation system is further operable in a second operating mode in which the volume of the oxygen-reduced gas mixture provided continuously at the outlet per unit of time is increased in comparison to the first operating mode relative to a reference value of a residual oxygen concentration, wherein a specific output of the gas separation system is lower in the first operating mode than a specific output of the gas separation system in the second operating mode, wherein the gas separation system is configured to be operable in either a VPSA mode or a PSA mode, and wherein the first operating mode of the gas separation system corresponds to the VPSA mode and the second operating mode of the gas separation system corresponds to the PSA mode.

12. The system according to claim 11, wherein the system further comprises a compressor system connected to the gas separation system for compressing an initial gas mixture, wherein the gas separation system removes at least a portion of oxygen contained in the compressed initial gas mixture and provides a nitrogen-enriched gas mixture at the outlet of the gas separation system, and wherein a compression ratio of the compressor system can be set such that the initial gas mixture can be compressed in the compressor system either to a first low pressure value or a second high pressure value, and wherein the initial gas mixture is compressed to the first low pressure value in the first operating mode of the gas separation system and the initial gas mixture is compressed to the second high pressure value in the second operating mode.

13. The system according to claim 11, wherein the gas separation system is operated in the second operating mode when the oxygen concentration in the spatial atmosphere of the enclosed area exceeds a predefined upper limit value or a definable upper limit value in particular due to an increased average air exchange rate over time, wherein a predefined upper oxygen concentration limit value or a definable upper oxygen concentration limit value corresponds to an oxygen concentration at or above the oxygen concentration corresponding to the predefined operating concentration, and wherein the predefined upper oxygen concentration limit value or the definable upper oxygen concentration limit value corresponds to an oxygen concentration at a maximum of 1.0% by volume above the oxygen concentration corresponding to the predefined operating concentration.

14. The system according to claim 13, wherein the gas separation system is operable at least at two different predefined output levels in the second operating mode, wherein the at least two output levels differ in that a volume of oxygen-reduced gas mixture able to be provided by the gas separation system per unit of time is higher at a second output level compared to a first output level and in relation to a predefined residual oxygen content reference value, and wherein the output level of the gas separation system in the second operating mode is automatically selected as a function of a degree to which the predefined upper oxygen concentration limit value or the definable upper oxygen concentration limit value is exceeded.

15. The system according to claim 11, wherein the gas separation system is further operable in a third operating mode in which the volume of the oxygen-reduced gas mixture continuously provided at the outlet per unit of time is reduced relative to a reference value of a residual oxygen concentration compared to the first operating mode, wherein the specific output of the gas separation system in the first operating mode is higher than a specific output of the gas separation system in the third operating mode, and/or wherein the gas separation system is operated in the third operating mode when the oxygen concentration in the enclosed area falls below a predefinable lower oxygen concentration limit value particularly due to a reduced average total air exchange rate over time, wherein the predefinable lower oxygen concentration limit value corresponds to an oxygen concentration at or above the oxygen concentration corresponding to the predefined lower limit concentration or the definable lower limit concentration.

* * * * *